US005328103A

United States Patent [19]

Komarovsky

[11] Patent Number: 5,328,103

[45] Date of Patent: Jul. 12, 1994

[54] PROCESS FOR IMPACT CRUSHING OF ROCK AND ORE LUMPS AND AN APPARATUS FOR PERFORMING SAME

[76] Inventor: Evarest B. Komarovsky, ulitsa Lermontova, 24, kv. 94, Yakutsk, U.S.S.R.

[21] Appl. No.: 926,163

[22] Filed: Aug. 5, 1992

[51] Int. Cl.[5] ..... B02C 13/20

[52] U.S. Cl. ..... 241/5; 241/27; 241/29; 241/73; 241/154; 241/275

[58] Field of Search ..... 241/27, 29, 5, 275, 241/154, 189.1, 101.2, 73

[56] References Cited

U.S. PATENT DOCUMENTS

| | | | |
|---|---|---|---|
| 1,439,581 | 12/1922 | Sedberry | 241/154 X |
| 2,862,669 | 12/1958 | Rollins | 241/154 X |
| 3,707,266 | 12/1972 | Llabres | 241/154 |
| 4,143,823 | 3/1979 | Judson, Jr. | 241/189.1 X |

FOREIGN PATENT DOCUMENTS

| | | | |
|---|---|---|---|
| 9654961 | 6/1957 | Fed. Rep. of Germany | 241/189.1 |
| 2091446 | 1/1972 | France . | |
| 183053 | 6/1966 | U.S.S.R. . | |

OTHER PUBLICATIONS

Roots Division of Dresser/Holmes Ltd. Holmes-Hazemag Impact Crushers, 4 pages.

*Primary Examiner*—Mark Rosenbaum
*Assistant Examiner*—Frances Chin
*Attorney, Agent, or Firm*—Ladas & Parry

[57] ABSTRACT

A process for impact crushing of rock and ore lumps, in which a rock lump is subjected to a primary impact force $P_1$, and then the plurality of resultant smaller pieces are subjected to a secondary impact force $P_2$. The application of the impact forces $P_1$ and $P_2$ is synchronized in time. The velocity vector $V_1$ of the lump subjected to the primary impact force $P_1$ and the vector of the secondary impact force $P_2$ lie on a line running through the center of the lump mass. The invention also covers an apparatus for performing the above process, which comprises a housing accommodating a primary crushing rotor and a secondary crushing rotor, and also means for synchronizing the rotation of the secondary crushing rotor and the primary crushing rotor, coupled kinematically to said rotors. The secondary crushing rotor has two hammers, and its mass increases along the longitudinal axis of symmetry in a direction away from the axis of rotation.

12 Claims, 9 Drawing Sheets

ω2
a2
2
v
a1
1
ω1

ω2
a2
2
v1
P1
a1
1
0
ω1

ω2
P2
a2
v1
R
2
1
0
a1
ω1 a2
2
ω2
v2
1
ω1
a1 a2
ω3
ω2
2
a3
3
v
a1
0
1
ω1

ω2
a2
2
ω3
v1
a3
3
ω1
a1
0
1

ω2
2
P2
P2
a2
a3
v1
3
v1
ω1
a1
0
1

ω2
a2
ω3
2
3
a3
1
v2
ω2
v2
a1

PROCESS FOR IMPACT CRUSHING OF ROCK AND ORE LUMPS AND AN APPARATUS FOR PERFORMING SAME

FIELD OF THE INVENTION

The present invention relates to a process for impact crushing of rock and ore lumps, and to an apparatus for performing said process.

The invention can be employed to crush raw materials in the mining, chemical, construction and coal industries and to process mineral fertilizers and mineral feedstock.

Impact crushing is well known in engineering, and so is equipment, including numerous hammer and rotary crushers, to perform it.

BACKGROUND OF THE INVENTION

A prior art impact crushing process is carried out in several stages. At the first stage, the impact tool, or hammer, of the crusher strikes the lumps of feedstock entering the crushing chamber. Each of the lumps subjected to a primary impact force is broken up partially and thrown against a deflecting member at a definite velocity. At the second stage, a lump striking the deflecting element is subjected to a secondary impact force, which crushes the lump to a definite size. In a simple case, one deflecting member is used, in which case a lump is crushed in two stages, though the crushing result is minimal.

The deflecting members, which are arranged in succession one after another are metal plates, grid bars, rods, bars, or screens.

Three or four deflecting members, less frequently more than five members, are installed to improve the efficiency of crushing. In this case, a lump is crushed in an average of four to six stages.

From the viewpoint of energy transmission, impact against a stationary barrier has the weakest effect possible (ref. E. V. Alexandrov and V. V. Sokolinsky, "Applied Theory and Calculation of Impact Systems", Nedra Publishers, Moscow, 1969, p.p. 15 to 17).

The above-described process has a low crushing effect since the surface of the deflecting member has a single function, directing lumps of feed material back to the impact members of the primary crushing rotor. In this case, the energy of the deflecting member itself is not utilized.

Also widely used in the art are centrifugal impact crushers, in which rock lumps are engaged by an acceleration rotor or disk and imparted a considerable velocity of up to 100 or 120 m/sec. The centrifugal force throws the lumps against a barrier which is designed as a ring mounted fixedly or rotatably about a common center of rotation.

The impact of the rock lumps against the annular barrier and the pattern of subsequent crushing do not actually differ from the conventional impact crushing process. Furthermore, this process is characterized by considerable specific consumption and inefficient use of electric power.

Another prior art crusher comprises two horizontal rotors of the AP-CM type (ref., for example, prospectus of the Holmes Hazemag firm, Roots Division of Dresser Holmes, Ltd.).

The rotors are arranged one above the other in the crusher so that the line connecting the axes of rotation of the rotors is inclined to the horizontal plane at a certain angle. In this crusher, rock lumps are crushed successively by the primary crushing rotor, and then by the deflecting members provided along the periphery thereof, and finally further crushed by the secondary crushing rotor which is also provided with fixed or spring-biased deflecting members arranged along the periphery thereof. The crushing process is carried out in six to eight stages. To increase the frequency of collisions, one of the rotors is provided with six hammers.

This crusher has all the drawbacks indicated above, that is, considerable power consumption and low efficiency.

Yet another prior art impact crusher (ref., for example, French Patent No. 2,091, 446, 1972) comprises two rotors, the axes of which lie in a plane extending at an angle to the horizon and the rotors themselves are positioned one above the other. The rotors rotate in opposite directions. Both rotors crush the rock successively and are provided with fixed deflecting members as well. The crusher has a large overall height, is inconvenient to operate, and requires much power and metal.

A further prior art impact crusher comprises a housing having a primary crushing rotor secured therein, with two secondary crushing rotors and a charging hole provided above it, the housing wall serving as a feed chute to deliver rock and ore lumps to the primary crushing rotor, with a discharging hole provided beneath it (ref., for example, USSR Inventor's Certificate No. 183,053).

This crusher performs a process for impact crushing of rock and ore lumps, comprising subjecting a rock lump first to a primary impact force that causes the lump to break up into a plurality of smaller pieces which are then subjected to a secondary impact force having a stochastic force vector distribution profile.

In operation, the material to be crushed is directed to the primary crushing rotor and then thrown against the hammers of the secondary crushing rotors. In this crusher, the hammers of the secondary crushing rotors are used as the deflecting members.

Rock lumps are crushed in three stages. At the first stage, crushing occurs as the material is engaged by the primary crushing rotor hammers. At the second stage, the material is crushed as it is engaged by the secondary crushing rotor hammers. At the third stage, the lumps are finally broken up against the grid bars.

This crusher helps to slightly improve the efficiency of crushing and the quality of material. However, it, too, has a number of drawbacks, the principal of which are as follows:

- stochastic pattern of rock lump crushing because the arrangement and operation of all the rotors are not synchronized in time;
- the impact force delivered by the secondary crushing rotor to the lump has a low efficiency because the rotor has a low speed of rotation, but essentially because a direct central impact cannot be delivered;
- the mass of the secondary crushing rotors performing deflecting functions is focused in their centers, for which reason the disintegrating effect of the rotors cannot be utilized in full; and
- the arrangement of the primary and secondary crushing rotors on a vertical axis reduces the possibility of crusher efficiency being improved, increases the overall dimensions of the crusher and raises labor inputs for operation and maintenance.

SUMMARY OF THE INVENTION

The object of the present invention is to provide a process for impact crushing of rock and ore lumps, in which the synchronized effect of the primary crushing force applied to a large-size lump and a secondary crushing force applied to pieces of a smaller size makes it possible to increase significantly the efficiency of the crushing process, to crush very hard rocks, reducing them to a small size, and to decrease the number of crushing steps in the process.

Another object of the invention is to provide an apparatus for performing the above process.

This is achieved by providing a process for impact crushing of rock and ore lumps, comprising first subjecting a rock lump to a primary impact force which breaks up the lump into a number of smaller pieces, which are then subjected to a secondary crushing force with a stochastic force vector distribution profile, wherein, according to the invention, the effect of the primary impact force $P_1$ applied to a large-size lump is synchronized in time with the secondary impact force $P_2$ applied to pieces of smaller size, the velocity vector $V_1$ of the lump following the application of the primary impact force $P_1$ and the vector of the secondary impact force lies on a line running through the center of the lump mass, and the ratio of the momentum imparted to the lump by the secondary impact force $P_2$ to the momentum imparted to the lump by the primary impact force $P_1$ lies within the range of 0.3 to 70.0 at a minimum value of the momentum the lump is imparted by the primary impact force $P_1$ equal to 180 kgm/sec.

This is achieved by providing an impact crusher comprising a housing having a primary crushing rotor secured therein, with a secondary crushing rotor and a charging hole provided above it, the housing wall serving as a feed chute to supply rock and ore lumps on to the primary crushing rotor, with a discharging hole provided underneath it. The invention has means to synchronize the rotation of the secondary crushing rotor with that of the primary crushing rotor, said means being coupled kinematically with said primary and secondary crushing rotors, the secondary crushing rotor carrying at least two hammers and having, in a plane normal to the axis of rotation thereof, a variable curvature section profile of an impact deflecting surface so that its mass increases along the longitudinal axis of symmetry in the direction away from the axis of rotation so that its moment of inertia is equal to more than five times the moment of inertia along the transverse axis of symmetry.

It is preferred that said means for synchronizing the rotation of the secondary crushing rotor and the primary crushing rotor is in the form of a toothed chain transmission, the gears of which are fitted on the shafts of the respective rotors.

It is advantageous that said synchronizing means should be in the form of a gear chain transmission, the gears of which are fitted on the shafts of the respective rotors.

It is preferred that said means for synchronizing the rotation of the secondary crushing rotor and the primary crushing rotor be in the form of a gear transmission.

It is also useful for said means for synchronizing the rotation of the secondary crushing rotor and the primary crushing rotor to be in the form of a stepless transmission.

It is useful that the impact deflecting surface of the secondary rotor should be a surface of revolution, the radius of curvature of which should be equal to the distance from the intersection point of the feed chute plane and the circle of a maximum radius $R_1$ of rotation of the primary crushing rotor to the impact deflecting surface of the secondary crushing rotor in a position when said radius of curvature is normal to the longitudinal axis of the secondary crushing rotor.

It is preferable that the impact deflecting surface of the secondary crushing should be riffled.

It is preferred that the crusher should comprise another secondary crushing rotor provided in a symmetric mirror position relative to the first secondary crushing rotor at a minimum spacing when the longitudinal axis of each rotor is normal to the radius of curvature of the impact deflecting surface extending through the center of rotation of the rotor, and should be provided with means allowing the secondary crushing rotors to rotate in the opposite directions, said means being kinematically coupled with said rotors.

It is also useful that the impact deflecting surface of the secondary crushing rotor should have a biconcave profile in a section normal to the axis of rotation.

It is preferred that the impact deflecting surface of the secondary crushing rotor should have a straight portion conjugating with a curved portion in a section normal to the axis of rotation.

DESCRIPTION OF THE DRAWINGS

The invention is further illustrated by the description of a specific embodiment thereof with reference to the accompanying drawings, wherein.

DETAILED DESCRIPTION OF THE PREFERRED EMBODIMENTS

The process for impact crushing of rock and ore lumps is carried out as follows:

First, attention is turned to lump reduction in a crusher containing a single primary crushing rotor and a single secondary crushing rotor.

Figures 1A, 1B, 1C, 1D:
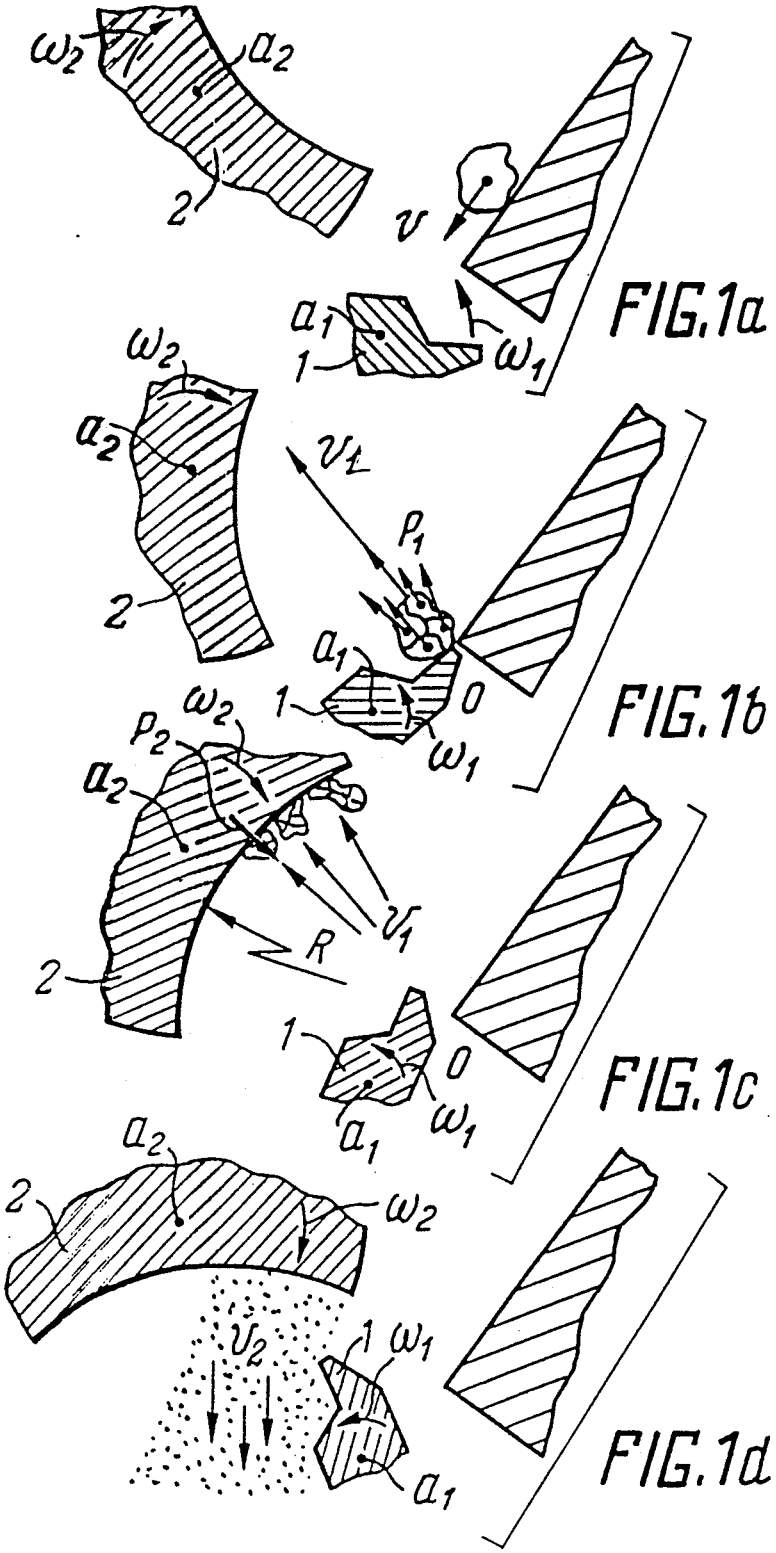
FIGS. 1*a*, 1*b*, 1*c* and 1*d* show diagrammatically the reduction of a rock lump by the present process of impact crushing by means of two rotors, a primary and a secondary crushing rotors, according to the invention.

A rock lump to be reduced is first subjected to a primary impact force, for which purpose the rock lump is advanced at a speed V along an inclined chute to a primary crushing rotor 1 (FIG. 1*a*). The impact breaks up the lump into a number of smaller pieces, which are imparted by the impact a resultant velocity $V_1$ (FIG. 1*b*) directed toward a second rotor 2. The rotor 1 rotates at an angular velocity $\omega_1$.

The rotor 2 rotates at an angular velocity $\omega_2$ in a direction opposite to the rotor 1. As the smaller pieces reach the secondary crushing rotor 2 they are subjected to a secondary impact force (FIG. 1*c*).

The process is performed so that the primary impact force $P_1$ applied to the larger lump is synchronized with the secondary impact force $P_2$ applied to the smaller pieces. Furthermore, the velocity vector $V_1$ of the lump subjected to the primary impact force $P_1$ and the vector of the secondary impact force $P_2$ lie on a line passing through the center of the lump mass. A deflecting member of the secondary crushing rotor 2 performs not only the passive deflecting and partial lump reducing function, but is actively involved in the crushing process by transferring part of its kinetic energy to the lump.

Furthermore, the momentum imparted to the lump by the secondary impact force $P_2$ is proportional to the momentum imparted to the lump by the primary impact force $P_1$, and ranges from 0.3 to 70.0 times the value of $P_1$, at a minimum momentum imparted by the primary impact force $P_1$ equal to 180 kgm/sec.

The secondary impact force $P_2$ reduces the smaller pieces to still smaller particles, which are thrown against a bar screen at a velocity $V_2$(FIG. 1*d*).

Crushing is carried out more effectively in a crusher comprising one primary crushing rotor 1 and two secondary crushing rotors 2 and 3.

Figures 2A, 2B, 2C, 2D:
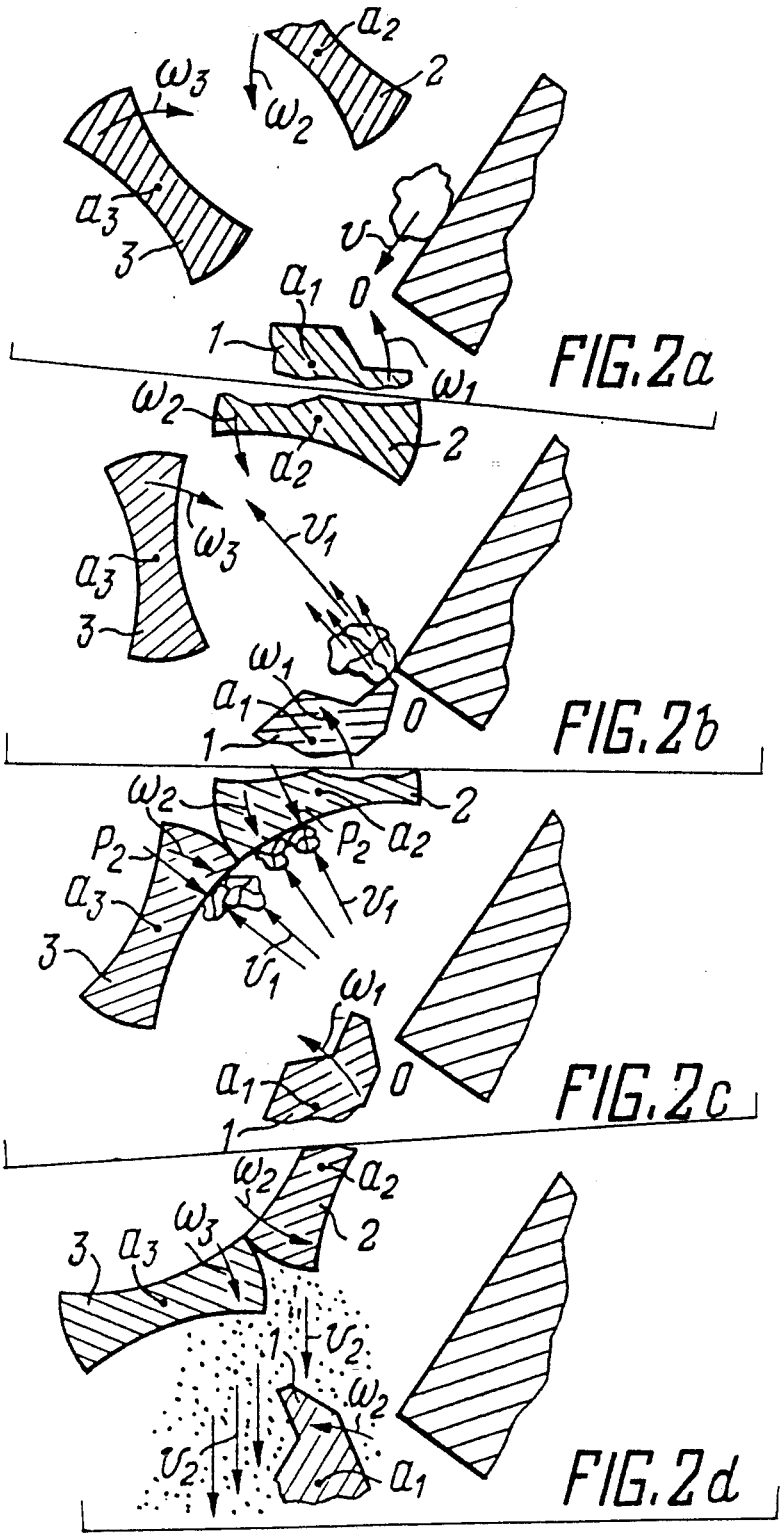
FIGS. 2*a*, 2*b*, 2*c* and 2*d* show diagrammatically the reduction of a rock lump by the present process of impact crushing by means of three rotors, one of which is a primary crushing rotor and the other two are secondary crushing rotors, according to the invention.

In this case, a rock lump is first subjected to a primary impact force, for which purpose the rock lump is advanced at a velocity V along an inclined chute to the primary crushing rotor 1 (FIG. 2*a*). The rotor rotates at an angular velocity $\omega_1$. The impact breaks up the lump into a number of smaller pieces which are imparted by the impact a velocity $V_1$ (FIG. 2*b*) directed toward the secondary crushing rotors 2 and 3. The rotors 2 and 3 rotate at angular velocities $\omega_2=\omega_3$ directed toward each other. The pieces reach the rotors 2 and 3 and are subjected to the secondary impact force $P_2$ (FIG. 2*c*).

The impact forces $P_1$ and $P_2$ are synchronized in time. In addition, the vector of the lump velocity $V_1$ produced by the first impact force $P_1$ and the vector of the secondary impact force $P_2$ lie on a line running through the center of the lump mass.

The active operating mode imparted to the deflecting members of the secondary crushing rotors 2 and 3, which transmit part of their kinetic energy, added up with the energy acquired by the lumps under the effect of the primary impact force $P_1$, to the material being reduced influences significantly the lump reduction results. The total kinetic energy is released upon the active collision of the lump and the deflecting member over a period of time considerably shorter than the normal collision time in conventional impact crushers. This energy produces fields of super-critical stress that exceeds the strength of all rock types. Deformation processes set off by an impact cause irreversible changes in the solid-state condition of rock lumps and their rapid disintegration into small particles (FIG. 2*d*). The significant distinctions of the process contribute new properties to the reduction process, in particular, a rapid rise in the efficiency of crushing and formation of a fine-grained product of a substantially isometric shape.

It has been observed that by changing the collision conditions, that is, controlling the weight and speed parameters of the force vectors, it is possible to control the reduction process to obtain a product of a desired granulometric composition, the less resistant reduction products being discharged into the minus class.

Figure 3:
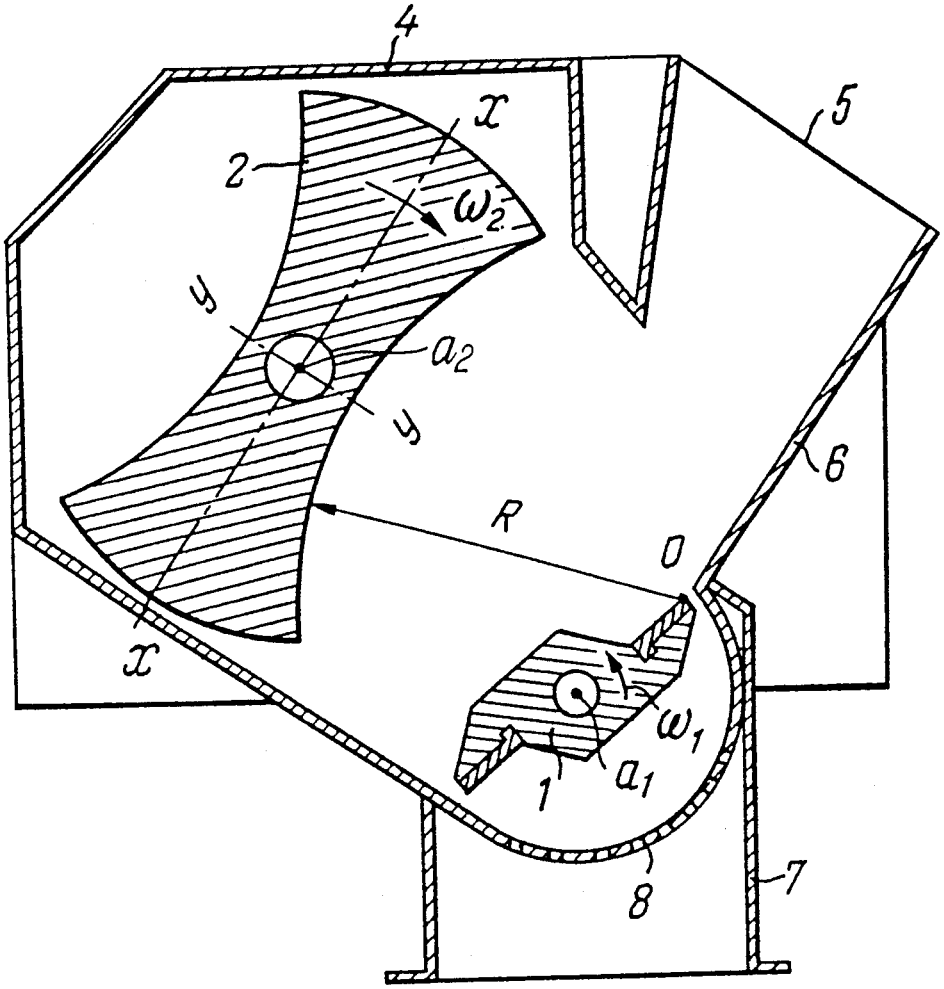
FIG. 3 shows a diagrammatic view of an impact crusher having a primary crushing rotor and a secondary crushing rotor, according to the invention.

The impact crusher comprises a housing 4 (FIG. 3) having a primary crushing rotor 1 secured therein and a secondary crushing rotor 2 fixed over the latter. The housing 4 has a charging hole 5 located above the rotor 1, the wall of the housing 4 serving as a feed chute 6 to deliver rock and ore lumps onto the primary crushing rotor 1. A discharging hole 7 with a bar grid 8 is provided under the rotor 1.

The crusher comprises means for synchronizing the rotation of the secondary crushing rotor and the primary crushing rotor, said means being connected kinematically to the rotors 1 and 2.

Following below is a description of specific embodiments of said means for synchronizing the rotation of the secondary crushing rotor and the primary crushing rotor.

In the embodiment described, the secondary crushing rotor 2 has two hammers and has a variable curvature impact deflecting surface in a plane normal to the axis of rotation $a_2$ so that the mass of the rotor 2 increases along the longitudinal axis of symmetry X—X in the direction away from the axis of rotation $a_2$. The moment of inertia of the rotor 2 along the longitudinal axis of symmetry X—X is more than five times the moment of inertia along the transverse axis of symmetry Y—Y.

In the embodiment described, the means for synchronizing the rotation of the secondary crushing rotor and the primary crushing rotor is made in the form of a toothed chain transmission.

Figure 4:
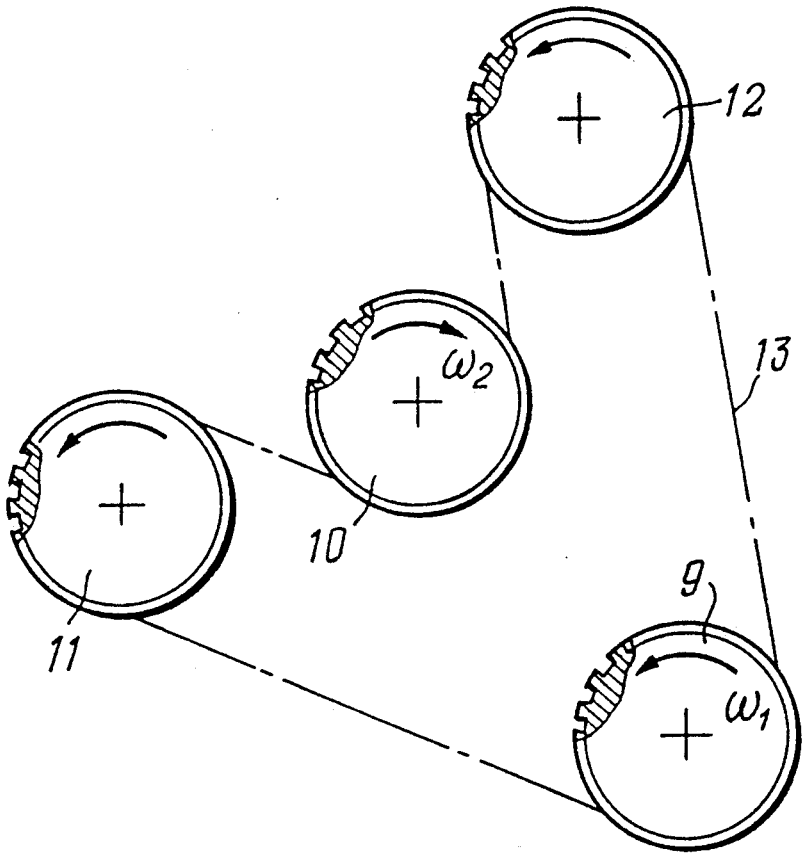
FIG. 4 shows a diagrammatic view of means for synchronizing the rotation of the secondary crushing rotor and the primary crushing rotor (embodiment in the form of a toothed chain transmission), according to the invention.

A sprocket 9 (FIG. 4) is fitted on the same shaft (not shown) as the rotor 1, and a sprocket 10, on the same shaft as the rotor 2. Numeral 11 designates a tension sprocket, numeral 12 a guide sprocket and numeral 13 a toothed chain.

In another embodiment (not shown), the means for synchronizing the rotation of one secondary crushing rotor with the primary crushing rotor is a gear chain transmission. Similar to the above, the gears of this transmission are fitted on the respective shafts of the rotors 1 and 2.

Figure 5:
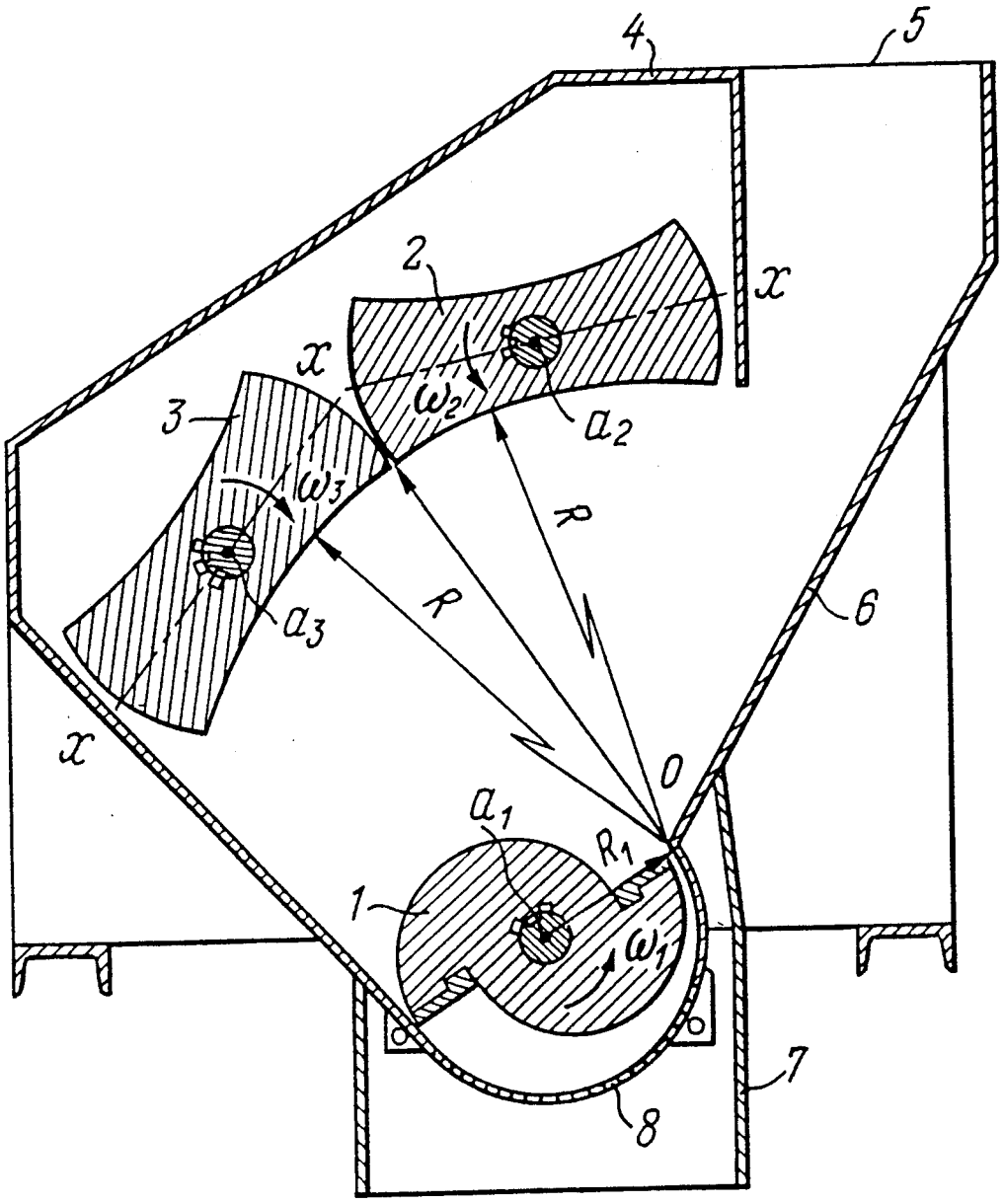
FIG. 5 shows a diagrammatic cross-sectional view of an impact crusher having a primary crushing rotor and two secondary crushing rotors, according to the invention.

In another embodiment, the impact crusher comprises two secondary crushing rotors 2 and 3 (FIG. 5).

The rotors 2 and 3 are arranged in a symmetrical mirror pattern in a position where the longitudinal axis X—X of each rotor 2 and 3 is normal to the radius of curvature of the impact deflecting surface running through the centers $a_2$ and $a_3$ of rotation of the rotors. The crusher is further provided with means which synchronizes the rotation of the secondary crushing rotors and the primary crushing rotor. Also, the crusher comprises means causing the secondary crushing rotors to rotate in the opposite directions.

Figure 6:
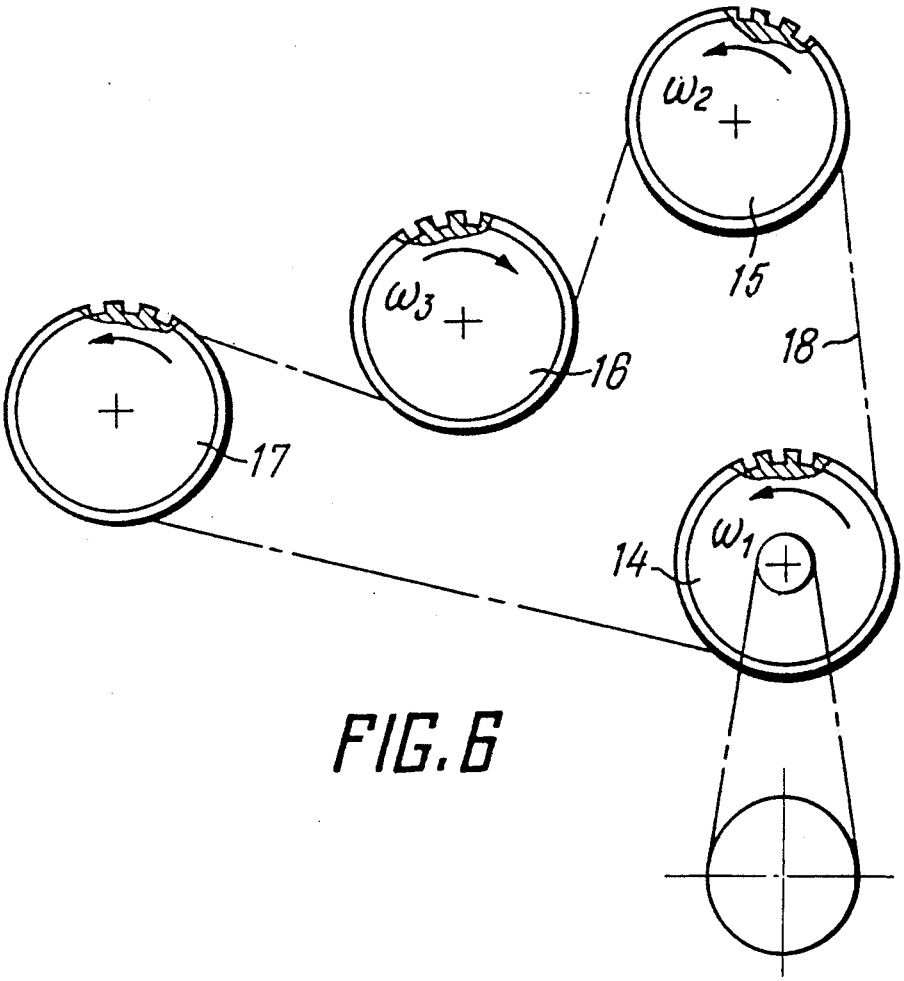
FIG. 6 shows a diagrammatic view of means for synchronizing the rotation of two secondary crushing rotors and a primary crushing motor (embodiment in the form of a toothed chain transmission), according to the invention.

In a still further embodiment, the means for synchronizing the rotation of the secondary crushing rotors and the primary crushing rotor is in the form of a toothed chain transmission. Similarly to the above-described, the sprockets of this gear are fitted each on the same shaft with the respective rotor. A sprocket 14 (FIG. 6) is fitted on a common shaft with the rotor 1, a sprocket 15, on a common shaft with the rotor 2, and a sprocket 16 on a common shaft with the rotor 3. The shafts are not shown in FIG. 6. Numeral 17 designates a tension sprocket and numeral 18, a toothed chain. Moreover, this transmission causes the secondary crushing rotors 2 and 3 to rotate in the opposite directions.

Figure 7:
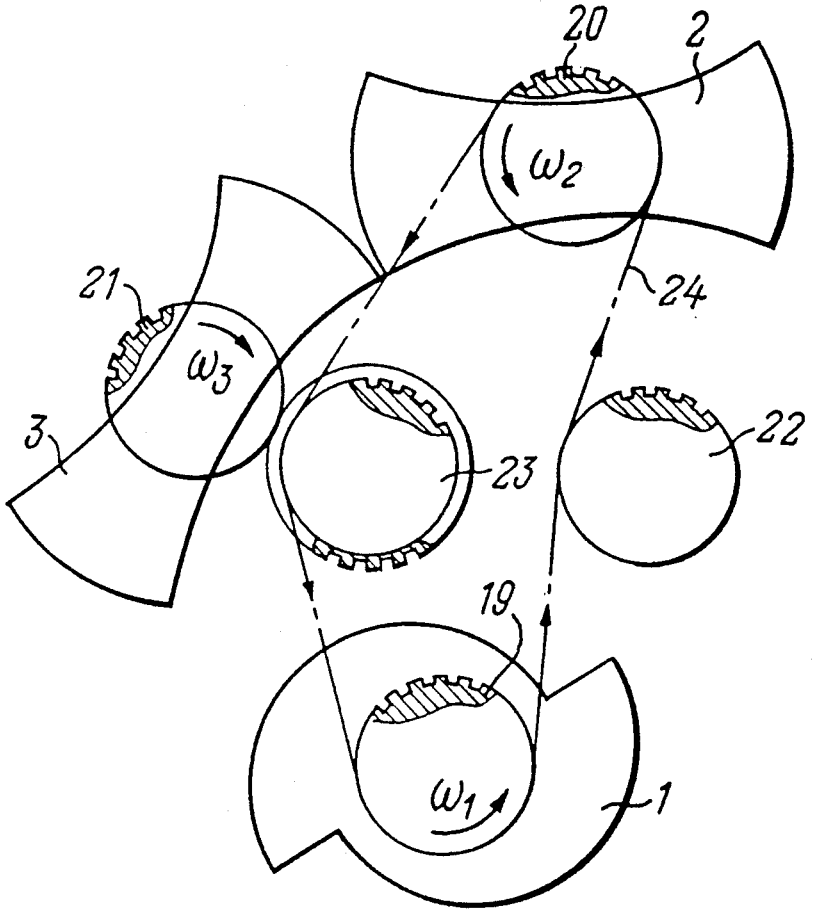
FIG. 7 shows a diagrammatic view of means for synchronizing the rotation of secondary crushing rotors and a primary crushing rotor (embodiment in the form of a gear chain transmission), according to the invention.

In yet another embodiment, the means for synchronizing the rotation of the secondary crushing rotors and the primary crushing rotor is a gear chain transmission. In this embodiment, the gears can be fitted on common shafts with the rotors or, alternatively, the transmission may comprise a device kinematically couple to the shafts of the rotors 2 and 3 (FIG. 7). In the embodiment described, the gears are fitted each on a common shaft with a respective rotor. A gear 19 is fitted on the shaft of the rotor 1, a gear 20, on the shaft of the rotor 2, and a gear 21, on the shaft of the rotor 3. Numeral 22 designates a tension sprocket, numeral 23, a guide sprocket and numeral 24, a chain. In FIG. 7, it may be seen that the element denoted by numeral 23 is both a sprocket and a gear.

Figure 8:
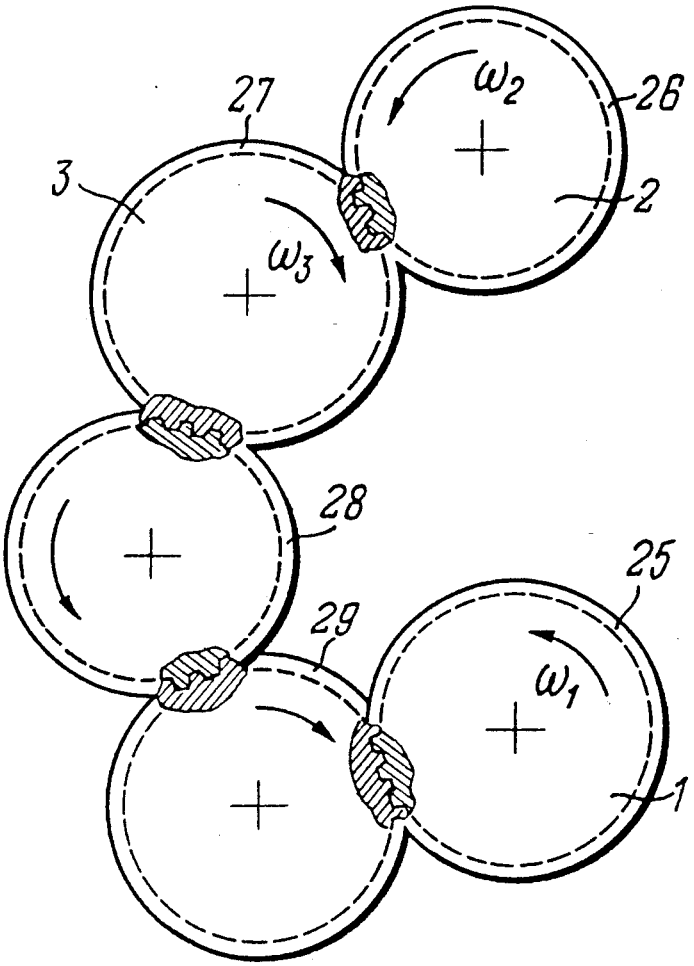
FIG. 8 shows a diagrammatic view of means for synchronizing the rotation of secondary crushing rotors and a primary crushing rotor (embodiment in the form of a gear transmission), according to the invention.

FIG. 8 illustrates an embodiment of the means for synchronizing the rotation of the secondary crushing rotors and the primary crushing rotor in the form of a gear transmission. A gear 25 is fitted on the shaft of the rotor 1, a gear 26, on the shaft of the rotor 2, and a gear 27, on the shaft of the rotor 3. Gears 28 and 29 form kinematic pairs.

In a still further embodiment, the means for synchronizing the rotation of the secondary crushing rotors and the primary crushing rotor is a stepless transmission, for example, expanding pulleys (not shown) or friction clutches.

Figure 9:
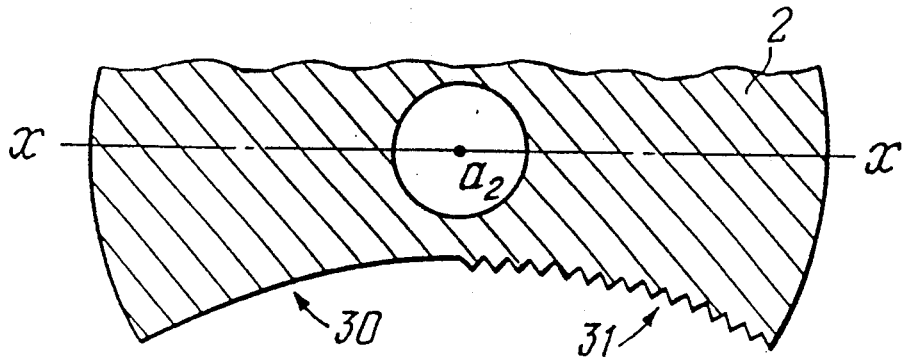
FIG. 9 shows a cross-sectional view of a secondary crushing rotor having an impact deflecting surface partially riffled, according to the invention.
Figure 10:
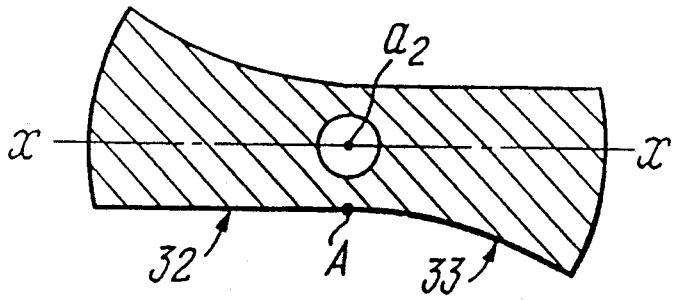
FIG. 10 shows a cross-sectional view of a secondary crushing rotor having an impact deflecting surface which has, in the section normal to the axis of rotation, a straight portion and a curved portion, according to the invention.

In the embodiment described, the impact deflecting surface of the secondary crushing rotor 2 (FIG. 5) is a surface of revolution, the radius R of curvature of which is equal to the distance from the intersection point 0 between the plane of the feed chute 6 and the circle of a maximum radius $R_1$ of rotation of the primary crushing rotor 1 and the impact deflecting surface of the secondary crushing rotor 2 in a position where said radius of curvature is normal to the longitudinal axis X—X of the secondary crushing rotor 2. Conventionally, said surface is smooth (numeral 30 in FIG. 9).

In an alternative embodiment, the impact deflecting surface is riffled, as shown by numeral 31.

The section of the impact deflecting surface of the secondary crushing rotor 2 normal to the axis of rotation may have a biconcave profile.

In another embodiment, the impact deflecting surface of the secondary crushing rotor 2 has, in a section normal to the axis of rotation, a straight portion 32 and a curved portion 33 which are conjugated at a point A.

The crusher is operated as follows:

A rock lump (FIG. 5) is delivered, through the charging hole 5, along the feed chute 6 on to one of the hammers of the primary crushing rotor 1. Having received a primary impact impulse from the latter, the lump is broken up into pieces and thrown toward the secondary crushing rotors 2 and 3. The paths of the lump piece originate at the point 0 lying on the front edge of the hammer of the primary crushing rotor 1 and fan out with a radius vector R. Since the rotation of the secondary crushing rotor 2, 3 is synchronized, through a kinematic link, with the rotation of the primary crushing rotor 1, its deflecting surface having a curved profile with a radius of curvature R occupies, at the moment of collision with the rock pieces, a position in which the radius vector of the material pieces is normal to each point of said surface.

During collision, the rock pieces absorb much more energy than is required to crush them, according to the equation:

$$W_\Sigma = W_1 + W_0,$$

wherein:

$W_\Sigma$ is the total energy absorbed by the the material being crushed;

$W_1$ is the energy acquired by the rock mass pieces after the primary impact; and $W_0$ is the energy of the deflecting member.

For this reason the rock pieces subjected to a secondary impact are disintegrated into very small particles, and the process as a whole develops in fast-flowing pulsating mode; moreover, owing to the opposite rotation of the primary and secondary crushing rotors the reduction products are withdrawn intensively through the discharging hole 7.

The distinguishing features of the process and crusher allow rocks to be processed by an effective and qualitatively new technique which is simplified and made considerably less costly by reducing the number of stages, decreasing the quantity of basic and ancillary equipment, and lowering capital and labor inputs.

Compared with the prior art crushing processes and crushing and grinding equipment, the present impact crushing process makes it possible to:

crush rocks of virtually any hardness class;

obtain a ground product of any desired grain size and quality in a single stage;

decrease power and metal consumption;

provide a high grinding degree;

obtain a crushed product of a substantially isometric shape; and lower operating costs and prime cost of processed mineral stock.

We claim:

1. A process for crushing rock and ore lumps comprising the steps of:

a) guiding a rock lump to a first rotor or first set of rotors, b) rotating the first rotor or first set of rotors so as to impart a primary impact force $P_1$ to the lump whereby to break the lump into a plurality of resultant pieces and propel the resultant pieces to a second rotor or second set of rotors with a velocity having a magnitude and direction defined by a velocity vector $V_1$ and with a momentum $M_1$, c) rotating the second rotor or second set of rotors so as to impart a secondary impact force $P_2$ to the resultant pieces whereby to break the resultant pieces into smaller pieces and propel the smaller pieces with a velocity having a magnitude and direction defined by a velocity vector $V_2$ and with a momentum $M_2$, d) aligning and synchronizing the rotation of the first and second rotors such that they cooperate to impart the primary impact force $P_1$ to the lump and the secondary impact force $P_2$ to the resultant pieces with the velocity vector $V_1$ imparted to said resultant pieces by the primary impact force $P_1$ and the velocity vector $V_2$ of the secondary impact force $P_2$ lying on a line passing through the center of mass of the resultant pieces and smaller pieces respectively and with the ratio of the momentum $M_2$ of the smaller pieces to the momentum $M_1$ of the resultant pieces lying within the range of about 0.3 to 70.0 with said momentum $M_1$ having a minimum value of about 180 kgm/sec.

2. An impact crusher for crushing rock and ore lumps comprising:

a housing having a bottom, a plurality of side walls and a cover, said cover forming a charging hole through which said rock and ore lumps can enter the housing, said bottom forming a discharging hole through which crushed rock and ore can pass from the housing;

primary crushing rotor means for crushing said rock and ore lumps, said primary crushing rotor means comprising a primary rotor fitted on a first shaft within the housing;

feed chute means for delivering said rock and ore lumps to said primary crushing rotor means, said feed chute means comprising at least one of said side walls;

secondary crushing rotor means for further crushing rock and ore lumps which have been crushed by said primary crushing rotor means, said secondary crushing rotor means comprising a secondary crushing rotor fitted on a second shaft within the housing, and having at least two hammers;

means for synchronizing rotation of the secondary crushing rotor and the primary crushing rotor, coupled kinematically with said primary and secondary crushing rotors, such that rock and ore lumps crushed by said primary crushing means can be further crushed by said secondary crushing means; said secondary crushing rotor comprising an impact deflecting surface having a section profile and a rotation axis, the section profile of the impact deflecting surface having a variable curvature in a plane normal to the rotation axis, said secondary crushing rotor having a mass, a longitudinal axis of symmetry and a transverse axis of symmetry, the mass of said secondary crushing rotor increasing along the longitudinal axis of symmetry in a direction away from the axis of rotation so that the secondary crushing rotor has a moment of inertia along the longitudinal axis of symmetry which is more than five times the moment of inertia along the transverse axis of symmetry.

3. A crusher as claimed in claim 2 wherein the primary crushing rotor is located proximal to the discharging hole of the bottom and the secondary crushing rotor is located proximal to the charging hole of the cover.

4. A crusher as claimed in claim 2, wherein said means for synchronizing the rotation of the secondary crushing rotor and the primary crushing rotor is a toothed chain transmission having a first gear wheel fitted on said first shaft of said primary crushing rotor, a second gear wheel fitted on said second shaft of said secondary crushing rotor, a chain running around said wheels, and a drive coupled kinematically to said chain.

5. A crusher as claimed in claim 2, wherein said means for synchronizing the rotation of the secondary crushing rotor and the primary crushing rotor is a gear chain transmission, comprising a first gear fitted on said first shaft of said primary crushing rotor, a second gear fitted on said second shaft of said secondary crushing rotor, a chain running around said gears, and a drive coupled kinematically to said chain.

6. A crusher as claimed in claim 2, wherein said means for synchronizing the rotation of the secondary crushing rotor and the primary crushing rotor is a gear transmission comprising a first gear fitted on said first shaft of said primary crushing rotor, a second gear fitted on said second shaft of said secondary crushing rotor, and a drive coupled kinematically to said gears.

7. A crusher as claimed in claim 2, wherein said means for synchronizing the rotation of the secondary crushing rotor with the primary crushing rotor is a stepless transmission.

8. A crusher as claimed in claim 2, wherein said impact deflecting surface of said secondary crushing rotor is a surface of revolution having a radius R of curvature equal to the distance from a point of intersection of the plane of said feed chute and a circle of a maximum radius $R_1$ of rotation of said primary crushing rotor to said impact deflecting surface of said secondary crushing rotor in a position in which said radius R of curvature of the secondary crushing rotor passes through the center of rotation of the secondary crushing rotor and is normal to the longitudinal axis of said secondary crushing rotor at said center of rotation.

9. A crusher as claimed in claim 2, wherein said impact deflecting surface of said secondary crushing rotor is riffled.

10. A crusher as claimed in claim 2, wherein a second secondary crushing rotor is provided within said housing in a symmetric mirror position relative to said first secondary crushing rotor at a minimum clearance in a position in which the longitudinal axis X—X of said first secondary crushing rotor and said second secondary crushing rotor is normal to the radius of curvature of said impact deflecting surface, said radius passing through the center of rotation of said secondary crushing rotors, said crusher having rotating means for rotating said first and second secondary crushing rotors in opposite directions, said rotating means being coupled kinematically to said secondary crushing rotors.

11. A crusher as claimed in claim 2, wherein said impact deflecting surface of said secondary crushing rotor has a biconcave profile in a section normal to the axis of rotation of said secondary crushing rotor.

12. A crusher as claimed in claim 2, wherein said impact deflecting surface of said secondary crushing rotor has, in a section normal to the axis of rotation, a straight portion and a curved portion conjugating therewith.

* * * * *